US007882682B2

(12) United States Patent
Martin

(10) Patent No.: US 7,882,682 B2
(45) Date of Patent: Feb. 8, 2011

(54) BALL GRIP AND FRICTION ENGAGING CAPPING CHUCK

(76) Inventor: Wendell Martin, 501 Phoenix Ave., Fort Smith, AR (US) 72916

( * ) Notice: Subject to any disclaimer, the term of this patent is extended or adjusted under 35 U.S.C. 154(b) by 0 days.

(21) Appl. No.: 12/460,239

(22) Filed: Jul. 15, 2009

(65) Prior Publication Data

US 2009/0308025 A1 Dec. 17, 2009

(51) Int. Cl.
*B67B 3/20* (2006.01)

(52) U.S. Cl. ..... 53/317; 53/420; 53/471; 53/287

(58) Field of Classification Search ..... 53/420, 53/471, 485, 490, 284.5, 287, 317, 331.5, 53/355, 345
See application file for complete search history.

(56) References Cited

U.S. PATENT DOCUMENTS

| | | | | |
|---|---|---|---|---|
| 2,819,577 | A | 1/1958 | Dimond | 53/317 |
| 2,884,751 | A | 5/1959 | Bjering | 53/317 |
| 3,427,786 | A * | 2/1969 | Nofer | 53/356 |
| 4,178,733 | A | 12/1979 | Dankert | 53/331.5 |
| 4,662,153 | A | 5/1987 | Wozniak | 53/331.5 |
| 4,756,137 | A | 7/1988 | Lanigan | 53/202 |
| 5,313,765 | A | 5/1994 | Martin | 53/317 |
| 5,437,139 | A | 8/1995 | Martin | 53/317 |
| 5,826,400 | A | 10/1998 | Martin et al. | 53/367 |
| 6,390,148 | B2 | 5/2002 | Martin | 141/39 |
| 6,457,916 | B2 * | 10/2002 | Wienhold | 408/240 |
| 7,131,245 | B2 | 11/2006 | Joerg et al. | 53/317 |
| 7,322,165 | B2 | 1/2008 | Spether | 53/331.5 |
| 7,377,085 | B2 | 5/2008 | Cirio | 53/317 |
| 7,654,779 | B2 * | 2/2010 | Sasaki et al. | 408/240 |
| 2004/0226926 | A1 | 11/2004 | Graffin | 53/75 |
| 2008/0141631 | A1 | 6/2008 | Brown | 53/490 |

* cited by examiner

*Primary Examiner*—Hemant M Desai
(74) *Attorney, Agent, or Firm*—Keisling & Pieper PLC; David B. Pieper

(57) ABSTRACT

A capping chuck including alignment balls for engaging the cap knurling. The capping chuck can also include internal knurling, and a friction engaging element for cap retention during the bottling process.

7 Claims, 5 Drawing Sheets

BALL GRIP AND FRICTION ENGAGING CAPPING CHUCK

CROSS-REFERENCE TO RELATED APPLICATIONS

This application claims benefit of U.S. patent application Ser. No. 11/975,687 filed Oct. 19, 2007, entitled "Ball Grip and Friction Engaging Capping Chuck", which claims benefit of U.S. Provisional Patent Application Ser. No. 60/853,141 filed Oct. 20, 2006, entitled "Friction Engaging Capping Chuck", and U.S. Provisional Patent Application Ser. No. 60/925,155 filed Apr. 19, 2007, entitled "Ball Grip Capping Chuck."

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in bottle capping machines or bottle filling and capping machines to improve the efficiency and reliability of handling plastic bottles which have become a very common container for beverages and, to some extent, other liquids. More particularly, the invention relates to improvements particularly suited for plastic bottles with pre-threaded screw caps. In particular, the present invention relates specifically to a friction engaging chuck used for placing the pre-threaded screw caps onto the bottles.

2. Description of the Known Art

As will be appreciated by those skilled in the art, capping chucks are known in various forms. Patents disclosing information relevant to capping chucks include U.S. Pat. No. 2,884,751, issued to Bjering on May 5, 1959; U.S. Pat. No. 4,756,137, issued to Lanigan on Jul. 12, 1988; U.S. Pat. No. 5,313,765, issued to Martin on May 24, 1994; U.S. Pat. No. 5,437,139, issued to Martin on Aug. 1, 1995; U.S. Pat. No. 5,826,400, issued to Martin et al. on Oct. 27, 1998; and U.S. Pat. No. 6,390,148, issued to Martin on May 21, 2002. Each of these patents are hereby expressly incorporated by reference in their entirety.

Thus, it may be seen that these prior art patents are very limited in their teaching and utilization, and an improved capping chuck is needed to overcome these limitations.

SUMMARY OF THE INVENTION

The present invention is directed to an improved capping chuck. In accordance with one exemplary embodiment of the present invention, a capping chuck is provided using a set of knurl engaging balls secured by an exterior elastomeric element and interior gap extentions combined with a frictional engaging elastomeric retention element. In accordance with another exemplary embodiment of the present invention, a capping chuck is provided using only a set of internally biased balls to align the cap into the chuck, hold the cap in position on the chuck, and then apply the installation torque for installing the cap onto the bottle or other structure. In both embodiments, the interior of the chuck is sized close to the external dimension of the cap or closure to stabilize the closure and prevent or reduce any type of rocking movement. New closure designs are utilizing multiple threads. For this type of multi-threaded design, it is critical to state or engage all of the threads substantially simultaneously. This requires very square alignment with the bottle threads in relation to that required for single thread closure designs. Thus, the present invention provides improved engagement over the prior art designs by improving the square hold of the cap while eliminating the problems with old ridge style capping chucks.

Advantages of the present invention include the use of gripping balls to perform one or more of the three functions of aligning the closure during insertion of the cap into the chuck, retain the closure or cap once it is in place in the chuck, and transferring the required torque force from the chuck to the cap for installation. In the second embodiment, all of these advantages are provided without the necessity for the internal ridges or teeth on the inside of the chuck.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
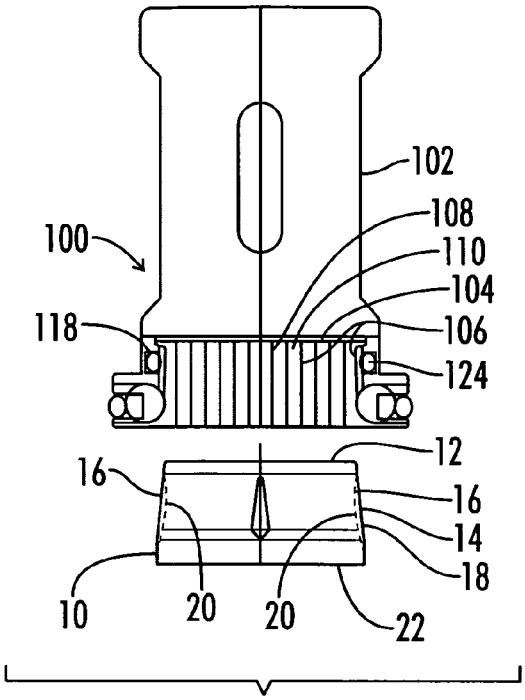
FIG. 1 is a cutaway schematic view of a capping chuck with a cap positioned below the chuck.
Figure 2:
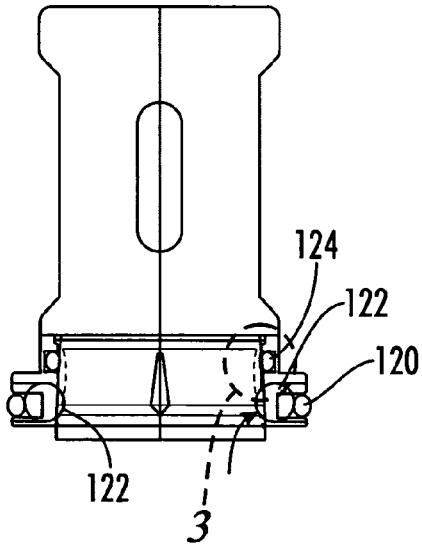
FIG. 2 is the cutaway schematic view of FIG. 1 with the cap inserted into the chuck.
Figure 3:
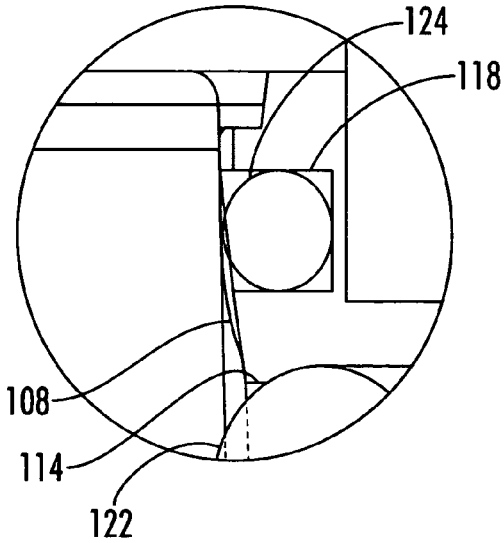
FIG. 3 is a magnified view of the ball contact and friction element contact with the cap.
Figure 4:
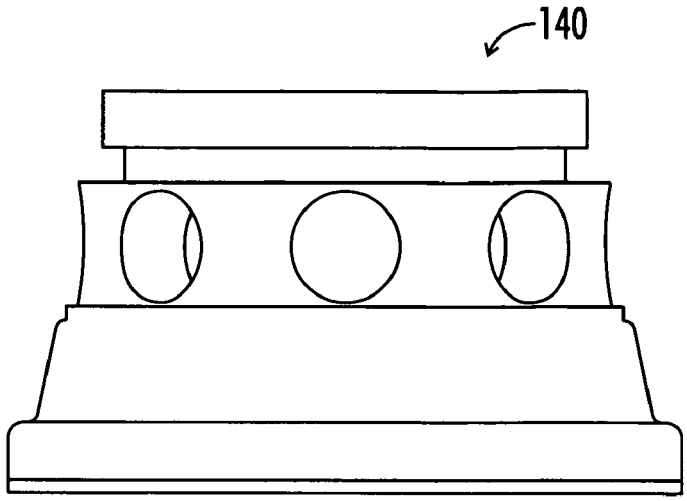
FIG. 4 is an assembled view of the chuck.
Figure 5:
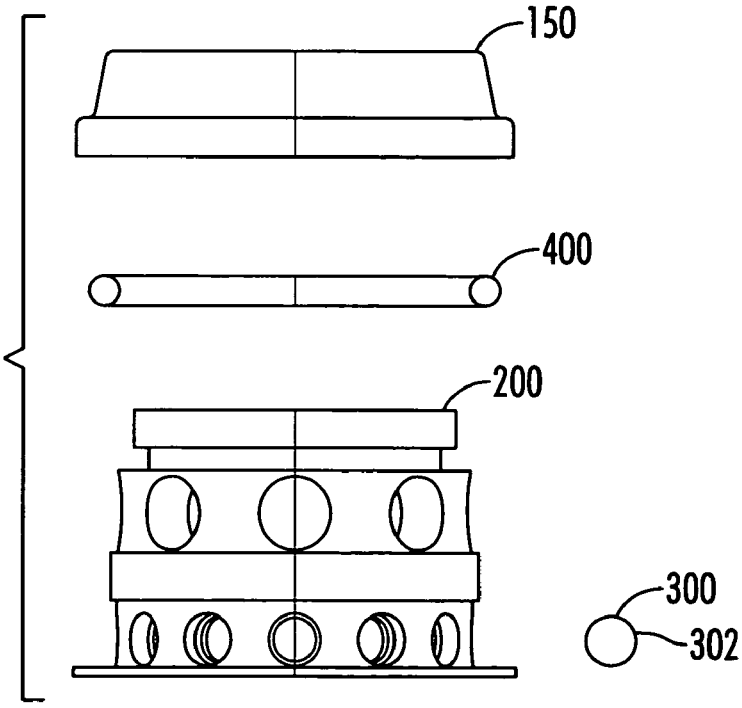
FIG. 5 is an exploded view of the chuck.
Figure 6:
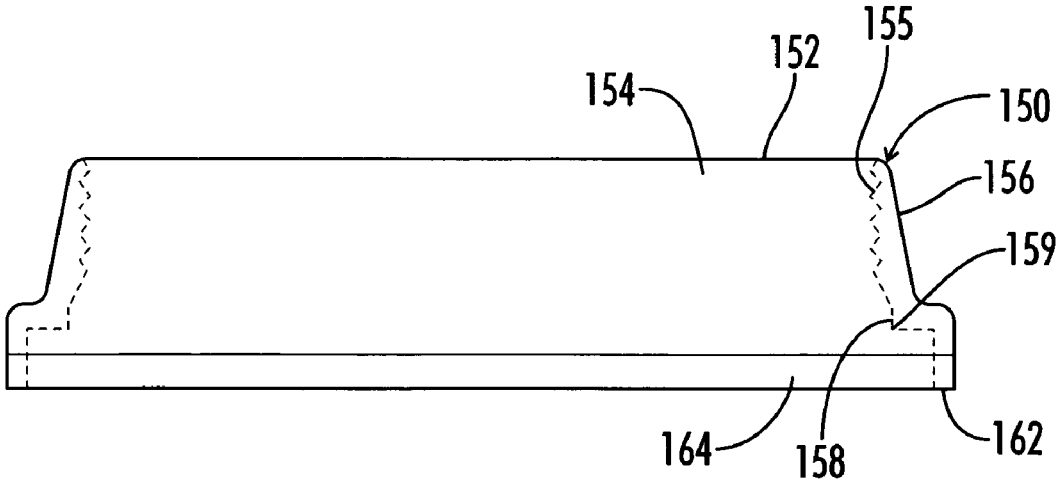
FIG. 6 is a side view of the ball retainer.
Figure 7:
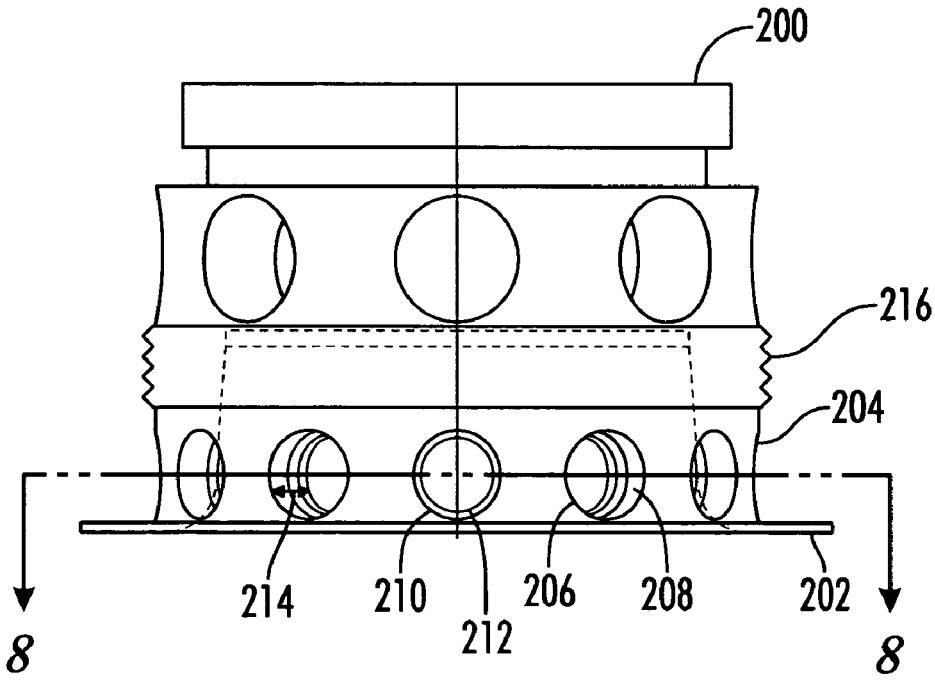
FIG. 7 is a side view of the chuck body.
Figure 8:
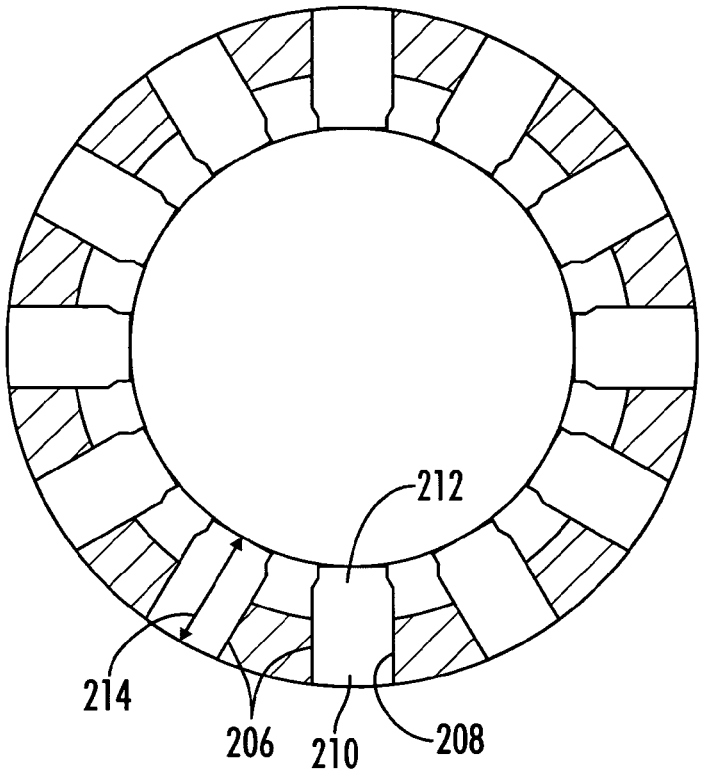
FIG. 8 is a cutaway view of the chuck body along line A-A.
Figure 9:
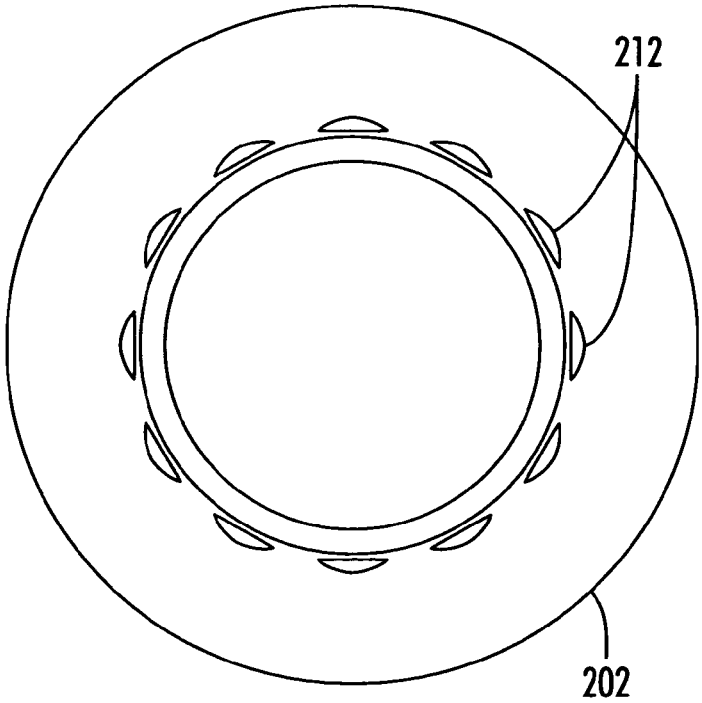
FIG. 9 is a bottom view of the chuck body.
Figure 10:
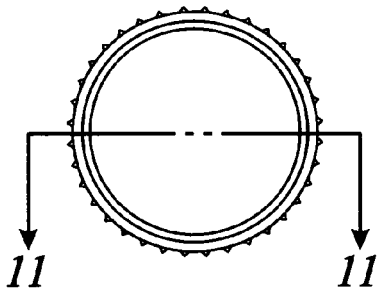
FIG. 10 is a bottom view of a cap with external knurling and internal threads.
Figure 11:
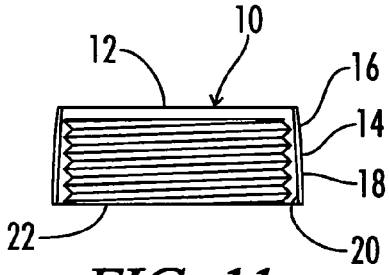
FIG. 11 is a cut away view of the cap along line B-B.
Figure 12:
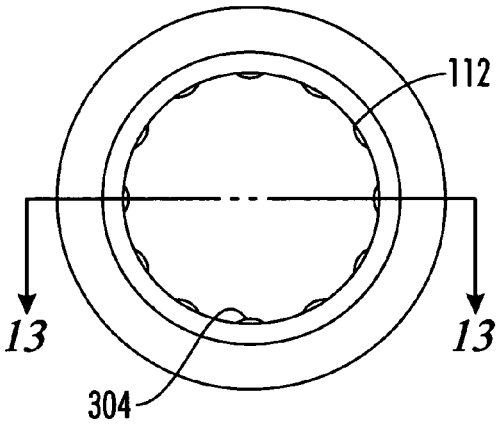
FIG. 12 is a bottom view of the assembled chuck.
Figure 13:
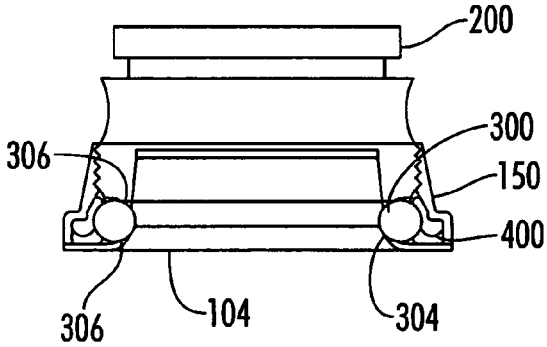
FIG. 13 is a cut away view of the assembled chuck along line C-C.
Figure 14:
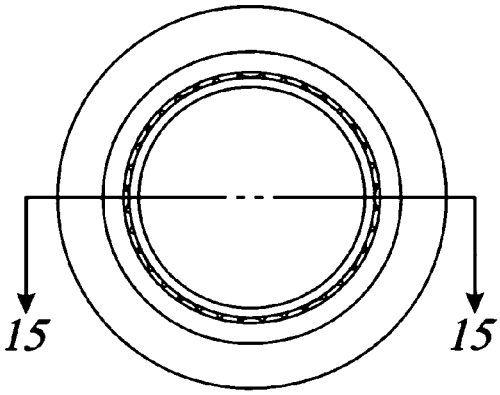
FIG. 14 is a bottom view of the assembled chuck with the cap inserted into the aperture.
Figure 15:
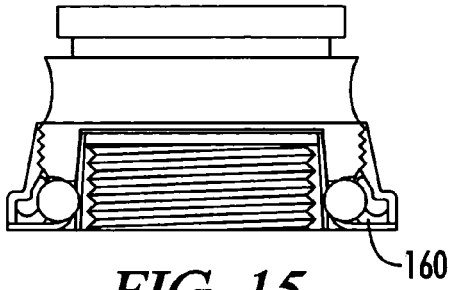
FIG. 15 is a cut away view of the assembled chuck with inserted cap along line D-D.

As shown in FIGS. 1-3 of the drawings, one exemplary embodiment of the present invention is generally shown as a capping chuck 100 for a screw type cap 10 positioned below the capping chuck 100. The cap 10 includes a top 12, angled outside edge 14, and a bottom 22. The outside edge 14 includes cap knurling 16 with cap ridges 18 and cap valleys 20.

The capping chuck 100 is constructed from the main body 102 which defines the cap aperture 104 and the internal chuck knurling 106. The chuck knurling 106 has chuck ridges 108 and chuck valleys 110 designed to mate with the cap knurling 16.

To align the cap knurling 16 and the chuck knurling 106, a ball ring 112 is formed with a retention edge 114 for positioning the innermost part of the knurling alignment balls 122 under the chuck ridges 108. An elastic ball retention ring 120 holds the knurling alignment balls 122 in position. The knurling alignment balls 122 are adapted to rotate the cap 10 if the cap knurling 16 is misaligned with the chuck 100.

If the cap knurling 16 is aligned with the chuck knurling 106 then the cap will slide into the cap aperture 104 and properly seat for installation on the bottle. The cap knurling 16 is aligned with the chuck knurling 106 when the cap ridges 18 slide in to the chuck valleys 110 and the chuck ridges 108 slide into the cap valleys 20. If the cap 10 is not in this alignment, then the cap 10 needs to be rotated into proper alignment. The knurling alignment balls 122 perform this function and this is why they are positioned under and in alignment with the chuck ridges 108.

If a cap ridge 18 is aligned with the chuck ridge 108 such that insertion will be a problem, then the first contact is made when the cap ridge 18 contacts the knurling alignment ball 122 and attempts to force the knurling alignment ball 122 outward. The elastic force provided by the elastic ball retention ring 120 counters this force and pushes back on the knurling alignment ball 122. This return force rotates the cap so that the knurling alignment ball 122 slips off of the cap ridge 18 and into the cap valley 20. With the knurling alignment ball 122 aligned with the chuck ridges 108 this rotation aligns the chuck ridge with the cap valley 20. Now the cap 10 may freely slide into the cap aperture 104.

Now that the cap 10 is inserted into the cap aperture 104, we may note that the angled outside edge 14 on the cap would also work with the force provided by the knurling alignment balls 122 to force the cap 10 downward and out of the cap aperture 104. To prevent this, the element retention aperture 118 is provide on the internal end of the cap aperture 104 and a frictional cap engaging element 124 is placed within the element retention aperture 118. The frictional cap engaging element 124 is a polyurethane ring in the preferred embodiment that is similar to an o-ring. Because the frictional cap engaging element 124 is positioned to form an area less than the size of the cap 10, when the cap 10 is inserted into the cap aperture 104 the cap 10 contacts the frictional cap engaging element 124 and this force results in an elastic deformation of the frictional cap engaging element 124. Because the frictional cap engaging element 124 is made from a material that frictionally engages the cap 10, this frictional cap engaging element 124 captures the cap and counteracts both the force of the gravity and the knurling alignment balls 122. The preferred embodiment, the frictional cap engaging element 124 is formed as a polyurethane ring, although other configurations such as a ring, c-clip, segment, or even a spring forced pad are envisioned as alternative to the ring type of design. Polyurethane was chosen for the preferred embodiment to provide both the frictional force and the elastic deformation capabilities, but any material that will grip the cap 10 may be used with and appropriate design to provide the gripping force.

As shown in FIGS. 4-15 of the drawings, another exemplary embodiment of the present invention is generally shown as a ball grip retention chuck 140. The ball grip retention chuck 140 is formed from the ball retainer 150 that retains the gripping balls 300 and the resilient pressure element 400 on the chuck body 200.

The ball retainer 150 has a top wall 152 defining a top aperture 154. The exterior wall 156 can be manufactured for the appropriate external shape of the completed ball grip retention chuck 140. The bottom wall 162 defines the bottom aperture 164 that slips over the chuck body 200 and directs the gripping balls 300 and the resilient pressure element 400 into place in the retention cavity 160. The interior wall 158 defines the inside retention thread 155 for engagement with the outside retention thread 216 on the chuck body 200. The interior wall 158 also defines a portion of the retention cavity 160. This interior wall 158 has a ball stop 159 that defines the outermost movement of the gripping balls 300 and the resilient pressure element 400 during operation of the chuck 140.

The chuck body 200 defines a bottom retention shoulder 202 that protects the resilient pressure element 400 during operation. The chuck body 200 also defines the exterior retention wall 204 with machine in place ball sockets 206 for holding the balls 300 in the proper angular position. The preferred embodiment uses twelve ball sockets 206 equally spaced around the chuck body 200. Each ball socket 206 includes a socket side wall 208 with an exterior ball insertion aperture 210 that allows the balls to placed into the socket 206 before the resilient pressure element 400 is put into place. Each ball socket 206 also defines an interior ball retaining aperture 212 so that the balls extend into the interior of the chuck body 200 without escaping from the ball socket 206. The socket depth 214 is controlled along with the size and strength of the gripping ball 300 and the resilient pressure element 400 to control the forces used on the capping closure.

Each gripping ball 300 has an exterior diameter 302 where any part of it can be used as an interior extension 304 and the surrounding increase in diameter is then used as a catch area 306 to keep the ball in the socket 206. This is mentioned because the ball is merely a convenient shape for achieving these features and other machined shapes are envisioned to be able to supply these characteristics.

Finally, the resilient pressure element 400 in the preferred embodiment is simply an elastic o-ring.

One key element to this design is that instead of relying on elastic stretching of the oring 400 to apply internal ball pressure to the cap, the present invention uses compression of the elastic material 400 between the ball 300 and the ball retainer 150 to supply the holding pressure for the balls. This is unique in that it increases the life of the capping chuck because the elastomeric material lasts longer in compression than it does in tension, and this secures the balls in case of a failure in the elastic material to provide a safer design.

Reference numerals used throughout the detailed description and the drawings correspond to the following elements:

Bottle cap 10
Top 12
Angled Outside edge 14
Knurling 16
  ridge 18
  valley 20
bottom 22
Capping chuck 100

Main body 102
Cap aperture 104
Chuck knurling 106
Chuck ridge 108
Chuck valley 110
Ball ring 112
Upper ball retention edge 114
Element retention aperture 118
Elastic ball retention ring 120
Knurling alignment balls 122
Frictional cap engaging element 124
Ball grip retention chuck 140
Ball retainer 150
Top wall 152
Top aperture 154
inside retention thread 155
Exterior wall 156
Interior wall 158
ball stop 159
Retention cavity 160
Bottom wall 162
Bottom aperture 164
Chuck body 200
Bottom retention shoulder 202
Exterior retention wall 204
Ball sockets 206
socket side wall 208
exterior ball insertion aperture 210
interior ball retaining aperture 212
socket depth 214
outside retention thread 216
Gripping Ball 300
Exterior diameter 302
Interior extension 304
Catch area 306
Resilient pressure element 400

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A capping chuck apparatus for use with a bottle cap defining a cap top, a cap bottom, and a cap side positioned between the top and bottom, the cap side including cap knurling, the apparatus comprising:

a chuck body defining an interior cap aperture with a perimeter defining at least one extension aperture;

at least one cap gripping element extending through the at least one extension aperture and positioned to engage said cap knurling to rotationally engage said bottle cap with said chuck body;

an elastic force element having an exterior surface and an interior surface, the interior surface contacting the exterior of the gripping elements and biasing the gripping elements into the cap aperture; and an exterior ball retainer contacting the exterior surface and capturing the elastic force element on the cap gripping elements such that the elastic force element is compressed between the ball and the exterior ball retainer when a cap is inserted into the cap aperture.

2. The apparatus of claim 1, the cap gripping elements comprising:

balls.

3. The apparatus of claim 1, the elastic force element comprising:

an circular ring.

4. The apparatus of claim 1, the extension apertures including an exterior ball insertion aperture.

5. The apparatus of claim 1, the extension apertures including an interior ball retaining aperture.

6. The apparatus of claim 1, the ball retainer defining a ball stop.

7. The apparatus of claim 1, the ball retainer being substantially rigid.

* * * * *